US009593548B2

(12) United States Patent
Hill et al.

(10) Patent No.: US 9,593,548 B2
(45) Date of Patent: Mar. 14, 2017

(54) SYSTEM AND METHOD FOR SAFELY CONDUCTING EXPLOSIVE OPERATIONS IN A FORMATION

(75) Inventors: Jim T. Hill, Kingwood, TX (US); Clinton C. Quattlebaum, Mansfield, TX (US); John D. Burleson, Denton, TX (US); Tony F. Grattan, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 475 days.

(21) Appl. No.: 13/981,530

(22) PCT Filed: Sep. 13, 2012

(86) PCT No.: PCT/US2012/054996

§ 371 (c)(1),
(2), (4) Date: Feb. 5, 2014

(87) PCT Pub. No.: WO2014/042633

PCT Pub. Date: Mar. 20, 2014

(65) Prior Publication Data

US 2014/0138090 A1 May 22, 2014

(51) Int. Cl.

| | |
|---|---|
| ***E21B 29/00*** | (2006.01) |
| ***E21B 43/1185*** | (2006.01) |
| ***F42B 3/10*** | (2006.01) |
| ***E21B 29/02*** | (2006.01) |

(52) U.S. Cl.
CPC ..... *E21B 29/02* (2013.01); *E21B 43/1185* (2013.01); *F42B 3/10* (2013.01)

(58) Field of Classification Search
CPC ..... E21B 29/02; E21B 43/1185; E21B 43/11857; F42B 3/10; F42B 3/16; F42B 3/18

See application file for complete search history.

(56) References Cited

U.S. PATENT DOCUMENTS 4,523,650 A 6/1985 Sehnert
5,159,145 A * 10/1992 Carisella ..... F42D 1/04 102/222
7,387,156 B2 * 6/2008 Drummond ..... E21B 43/1185 166/55.1

(Continued)

OTHER PUBLICATIONS

International Search Report & Written Opinion, International Application No. PCT/US2012/054996, 13 pgs, Mar. 21, 2013.

*Primary Examiner* — Michael Wills, III
(74) *Attorney, Agent, or Firm* — Scott Richardson; Baker Botts L.L.P.

(57) ABSTRACT

Method and system that permits explosive operations to be conducted concurrently with drilling and other wellsite operations involving an electrical top drive mechanism or other components that utilize electricity are disclosed. A platform is placed at a location where subterranean operations are to be performed. A first well bore is drilled in a formation using drilling equipment on the platform by activating a top drive. Concurrently with drilling the first well bore, a perforating operation is performed in a second well bore extending from the platform. The perforating operation is performed using a perforating gun that comprises at least one of an electric isolator and an explosive isolator. The perforating gun is activated when the perforating gun reaches a safe depth.

20 Claims, 5 Drawing Sheets

(56) References Cited

U.S. PATENT DOCUMENTS

| | | | | |
|---|---|---|---|---|
| 8,006,779 | B2 * | 8/2011 | Moore | E21B 43/11852 166/374 |
| 2004/0251050 | A1 | 12/2004 | Shahin | |
| 2008/0134922 | A1 * | 6/2008 | Grattan | E21B 43/1185 102/206 |
| 2011/0174487 | A1 * | 7/2011 | Burleson | E21B 43/1195 166/298 |
| 2012/0103223 | A1 | 5/2012 | Crawford | |
| 2012/0138286 | A1 * | 6/2012 | Mason | E21B 43/1185 166/55.2 |
| 2014/0091893 | A1 * | 4/2014 | Bonavides | H01H 5/04 337/4 |

* cited by examiner

SYSTEM AND METHOD FOR SAFELY CONDUCTING EXPLOSIVE OPERATIONS IN A FORMATION

RELATED APPLICATION

This application is a U.S. National Stage Application of International Application No. PCT/US2012/054996 filed Sep. 13, 2012, which designates the United States, and which is incorporated herein by reference in its entirety.

BACKGROUND

Hydrocarbons, such as oil and gas, are commonly obtained from subterranean formations that may be located onshore or offshore. Offshore operations are typically conducted from a floating rig or permanent platform offshore, while onshore operations may be performed on a land rig. The term "platform" as used herein includes both onshore and offshore applications, encompassing a floating rig, a permanent platform or a land rig. The development of subterranean operations and the processes involved in removing hydrocarbons from a subterranean formation are complex.

Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation. One of the processes often utilized in development of subterranean operations is perforating operations. Once a wellbore is created in the formation, it may be desirable to place a casing in the wellbore. Perforating refers to an operation whereby one or more holes may be created in the casing in order to connect it to the formation. In order to perforate the casing, a perforating gun may be directed downhole to a desired location and explosives contained therein may be detonated (or fired) to create the desired holes in the casing.

It is often desirable to perform a number of different subterranean operations simultaneously in order to maximize operational efficiency. However, some operations are currently not performed concurrently due to safety concerns. One such limitation may arise in instances when two or more wellbores are operated from the same platform. In such applications, the different wellbores may be at different stages of development. For instance, while one wellbore is being drilled, it may be necessary to perform perforating operations in another wellbore that is operated from the same platform.

Currently, the deployment of explosive devices containing electrical initiators concurrent with performance of subterranean operations involving an electrical top drive system is not permitted on the same platform. Perforating a wellbore utilizes explosive devices downhole. The explosive devices utilized are typically detonated using one or more electrical initiators that may be selectively activated. Additionally, the electrical top drive system used for performing drilling operations may incorporate a high torque electrical motor requiring a significant power supply. As a result, in the event of an electrical failure, sufficient electrical potential could lead to accidental initiation of the electrical initiators, in turn causing an undesirable initiation of the explosive devices of the perforating gun before the perforating gun has reached a desired location downhole. Therefore, traditionally, explosive operations involving electrical initiators are only permitted when the top drive system has been deenergized and isolated. However, due to significant operational costs associated with performance of subterranean operations, it is desirable to develop a method and system that facilitates performance of explosive operations downhole while the top drive system is operational.

BRIEF DESCRIPTION OF THE DRAWING(S)

The present disclosure will be more fully understood by reference to the following detailed description of the preferred embodiments of the present disclosure when read in conjunction with the accompanying drawings, in which like reference numbers refer to like parts throughout the views, wherein.

Figure 1:
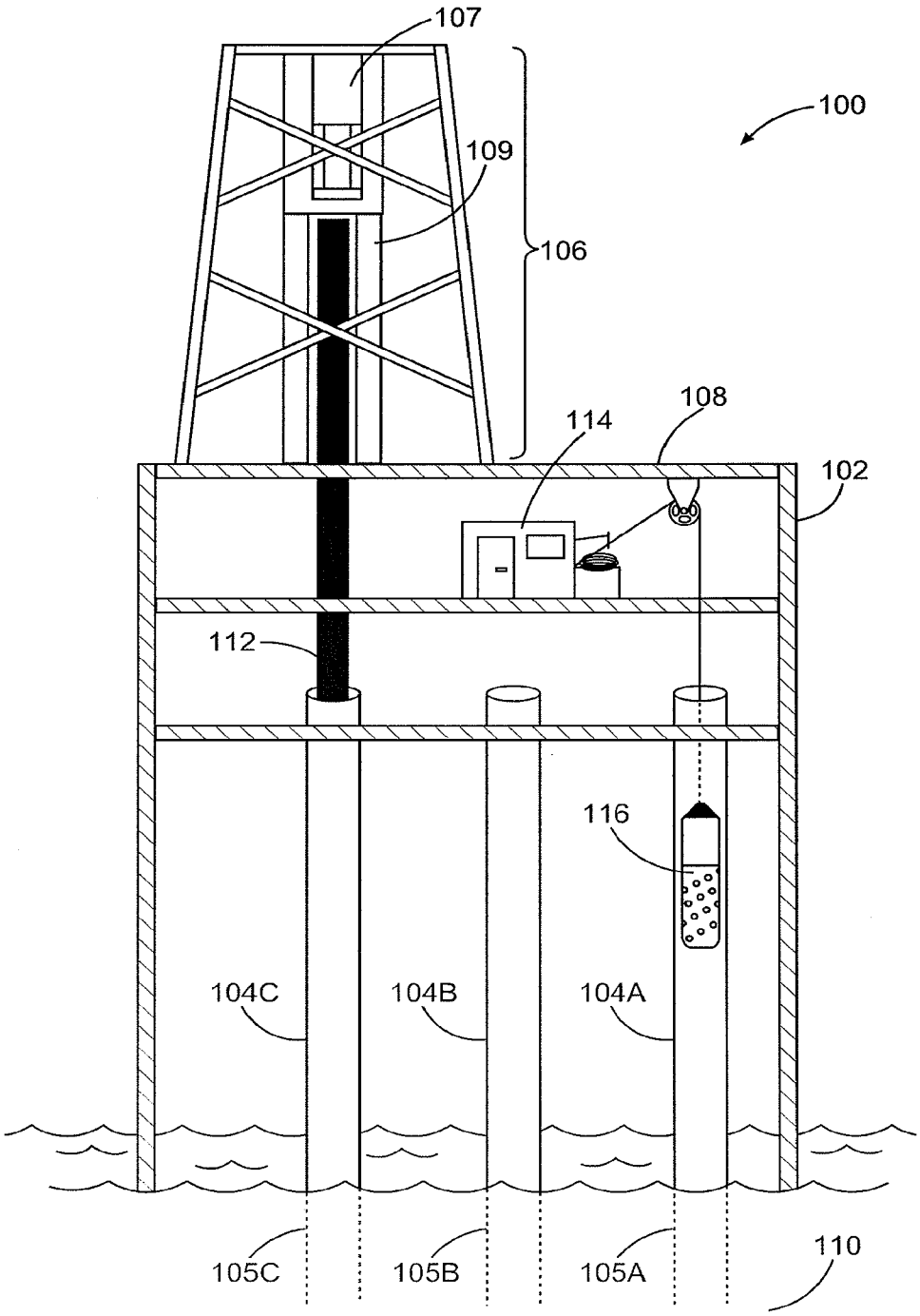
FIG. 1 is a system for performing subterranean operations in accordance with an embodiment of the present disclosure.

The disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes which come within the meaning and range of equivalency of the claims are therefore intended to be embraced therein.

DETAILED DESCRIPTION OF THE DISCLOSURE

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any foam of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; and/or any combination of the foregoing.

The term "uphole" as used herein means along the drillstring or the wellbore hole from the distal end towards the surface, and "downhole" as used herein means along the drillstring or the wellbore hole from the surface towards the distal end. The terms "couple" or "couples" as used herein are intended to mean either an indirect or a direct connection. Thus, if a first device couples to a second device, that connection may be through a direct connection, or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. Finally, the term "fluidically coupled" as used herein is intended to mean that there is either a direct or an indirect fluid flow path between two components.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The present invention is directed to improving performance of subterranean operations and more specifically, to a method and system that permits explosive operations to be conducted concurrently with drilling and other wellsite operations involving an electrical top drive mechanism or other components that utilize electricity.

Turning now to FIG. 1, a system for performing subterranean operations in accordance with an embodiment of the present disclosure is generally denoted with reference numeral 100. In one embodiment, the system 100 may include a platform 102 having one or more levels. A plurality of wellbores may be developed and operated using the system 100, from the same platform 102. In the exemplary embodiment of FIG. 1, three pipes 104A, 104B, 104C are used to couple the system 100 to the subsea formation 110. Each of the pipes 104A, 104B, 104C is coupled to a corresponding wellbore 105A, 105B, 105C that penetrates the formation 110 and provides a conduit for transfer of tools, hydrocarbons and/or other materials between the platform 102 and the formation 110. Accordingly, the wellbores 105A, 105B, 105C may be developed and operated using the system 100. The wellbores 105A, 105B, 105C may be in different stages of operation. Specifically, in the embodiment of FIG. 1, a first wellbore 105A and a second wellbore 105B may have already been drilled while a third wellbore 105C is being drilled into the formation 110. However, as would be appreciated by those of ordinary skill in the art, the present disclosure is not limited to any particular number of wellbores.

Drilling equipment 106 may be placed on the rig floor 108 in order to perform drilling operations. The drilling equipment 106 may include, but is not limited to, a drill string 112 that may be directed through the pipe 104C into the formation 110. The drill string 112 includes a drill bit (not shown) that drills the wellbore 105C into the formation 110. The drilling equipment 106 may include a top drive 107 that travels on a top drive track 109. The top drive 107 may be used to drive the drill bit into the formation 110 to create the wellbore 105C. In the embodiment of FIG. 1, the formation 110 is a subsea formation.

While the third wellbore 105C is being drilled, it may be desirable to perform other operations in the other wellbores 105A, 105B. For instance, it may be desirable to perform perforating operations in the first wellbore 105A while drilling (e.g., when a drill string is stuck) or after drilling in order to initiate production of hydrocarbons from a formation. Performance of perforating operations may be desirable for a number of reasons, including, but not limited to, well drilling, well completion, well remediation, and/or well intervention. In one embodiment, wireline perforating operations may be performed from the wireline perforating unit 114 that may be located on the platform 102 under the rig floor 108. In order to perform the perforating operations, a perforating gun 116 may be directed downhole through the pipe 104A into the first wellbore 105A. Once the perforating gun 116 is at a desirable depth in the wellbore 105A, one or more explosions may need to be initiated in order to perforate the casing downhole. One or more electrical initiators coupled to the perforating gun 116 may be activated from the wireline perforating unit 114 in order to initialize the explosions of the perforating gun 116.

In typical prior art systems, the drilling operations being performed in the third wellbore 105C must be stopped while perforating operations are being performed in the first wellbore 105A. Specifically, once the top drive is activated, the operation of the top drive 107 on the third wellbore 105C may generate a voltage leakage that may impact the electrical initiators of the perforating gun 116 causing unwanted explosions prior to the perforating gun 116 reaching a desired depth. As a result, the drilling operations of the third wellbore 105C are typically halted until the perforating gun 116 has reached a depth that is outside the range of the voltage leakage from the top drive 107. Drilling operations on the third wellbore 104C are then restarted.

Figure 2:
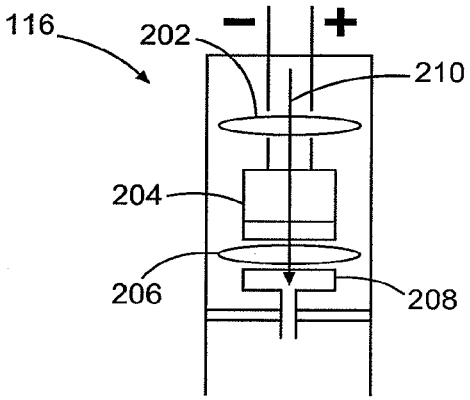
FIG. 2 is an improved perforating gun in accordance with an exemplary embodiment of the present disclosure.

However, in accordance with an embodiment of the present disclosure, one or more specific safety devices may be used to isolate one or more portions of the perforating gun 116 from the leaked voltage generated by the components on the platform 102. Specifically, FIG. 2 depicts the improved perforating gun 116 in accordance with an exemplary embodiment of the present disclosure. The perforating gun 116 may include an electric isolator 202 that substantially isolates the electrical initiator 204 from the surface and an explosive isolator 206 that substantially isolates the electrical initiator 204 from the explosives 208 of the perforating gun 116. The term "substantially isolates" as used herein means that sufficient isolation is provided to facilitate performance of perforating operations without electrical leakage from platform 102 which can cause an undesired detonation. Although one electric isolator 202 and one explosive isolator 206 are shown in FIG. 1, in certain embodiments, only one of the two isolators may be used. Alternatively, in certain embodiments, more than one electric isolator 202 and more than one explosive isolator 206 may be used. The electric isolator 202 and the explosive isolator 206 regulate operation of a detonation pathway 210 that runs to and may be used to activate the explosives 208 of the perforating gun 116.

The electric isolator 202 and the explosive isolator 206 facilitate selective blocking of the detonation pathway 210 by being positioned in such a way to be in the pathway of the ballistic transfer of the perforating gun 116. Specifically, the electric isolator 202 is positioned so as to prevent unwanted electric activation of the electric initiator 204 and the explosive isolator 206 is positioned so as to prevent a detonation of the explosives 208 if the electrical initiator 204 fires at an undesired time/location. As discussed above, this is of particular importance when the perforating gun 116 is at or near the surface of the wellbore 105A or in proximity to the platform 102, therefore making it susceptible to exposure to leakage voltage from drilling operations in another wellbore 105C coupled to the platform 102. Once the perforating gun 116 is lowered to a safe depth within the wellbore 105A, the electric isolator 202 and the explosive isolator 206 may be deactivated, thereby permitting normal activation of the perforating gun 116. Accordingly, the deactivation of the electric isolator 202 and the explosive isolator 206 once the perforating gun 116 reaches a safe depth "activates" the perforating gun 116 so that it can perform desired operations. The term "safe depth" as used herein refers to a depth in the wellbore 105A where the perforating gun 116 is sufficiently removed from the platform 102 that voltage leakage from the components on the platform 102 will not impact the operation of the perforating gun 116 and will not cause unwanted explosions. In certain illustrative embodiments, the safe depth may be a depth of 200 ft. below the surface (for onshore applications) or 200 ft. below the mud line (i.e., seabed) (for offshore applications).

One or a combination of different mechanisms may be used to selectively operate the electric isolator 202 and/or the explosive isolator 206 in order to prevent an unwanted detonation of explosives 208 of the perforating gun 116.

In certain embodiments, the electric isolator 202 and/or the explosive isolator 206 may consist of a material which is thermally reactive and changes position due to temperature change to selectively "block" and "unblock" the detonation pathway 210. Accordingly, temperature changes resulting from the movement of the perforating gun 116 into the wellbore 105A may be used to control the transfer of electricity to the electric isolator 202 and/or the transfer of the detonation train to the explosives 208.

Figure 3A:
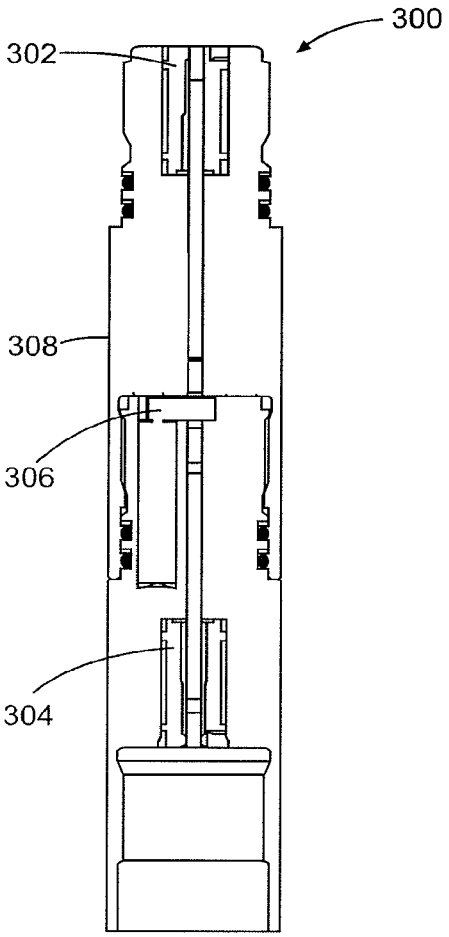
FIGS. 3A and 3B depicts a ballistic interrupt system in accordance with an illustrative embodiment of the present disclosure.
Figure 3B:
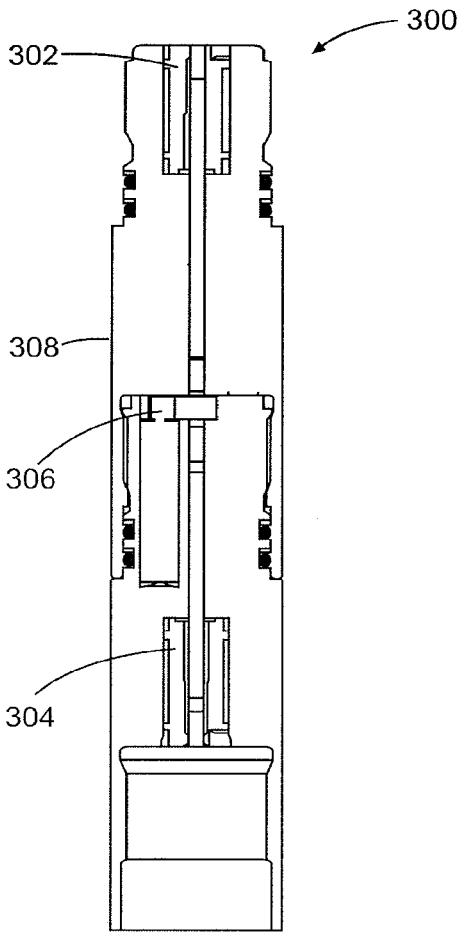

In certain embodiments, the electric isolator 202 and/or the explosive isolator 206 may comprise a ballistic interrupt. FIG. 3 depicts a ballistic interrupt in accordance with illustrative embodiments of the present disclosure, denoted generally with reference numeral 300. A ballistic interrupt 300 may be used to selectively provide ballistic coupling between a first ballistic terminal 302 and a second ballistic terminal 304. Specifically, the ballistic interrupt 300 may include a movable shield 306. The shield 306 may rotate based upon predefined conditions to block or unblock ballistic transfer between the first ballistic terminal 302 and the second ballistic terminal 304. Specifically, FIG. 3A depicts the position of the shield 306 which blocks ballistic transfer and FIG. 3B depicts position of the shield 306 that permits ballistic transfer between the two ballistic terminals 302, 304. The predefined conditions used to control the shield 306 position may include, but are not limited to, temperature.

In instances when temperature is used to control the position of the shield 306 (i.e., block/unblock the ballistic interrupt 300), any thermal electric switch may be utilized. For instance, the electric isolator 202 and/or the explosive isolator 206 may include a thermostat (not shown). Once the device reaches a predetermined temperature, the thermostat may switch the shield 306 from its block position (FIG. 3A) to its unblock position (FIG. 3B).

One or a combination of different methods may be utilized to block/unblock the ballistic interrupt 300. In certain illustrative embodiments, the ballistic interrupt 300 may utilize a spring contact point (not shown) whereby the spring can make electric contact once the shield 306 rotates, causing ballistic transfer between the two ballistic terminals 302, 304.

Moreover, in certain embodiments, the electric isolator 202 and/or the explosive isolator 206 may be regulated by gravity. Specifically, the electric isolator 202 and/or the explosive isolator 206 may be designed to react to gravity to create the block. The electric isolator 202 and/or the explosive isolator 206 may then be disabled once the perforating gun 116 enters a deviated part of the wellbore 105A. Specifically, in accordance with certain embodiments, the shield 306 may be free to rotate to the low side of the tool, away from the ballistic transfer, allowing the shield 306 to be uncovered when in deviated wells. Accordingly, the gravitational force may move the shield 306 between a first position (where it blocks ballistic transfer) and a second position (where ballistic transfer is unblocked).

Finally, in certain embodiments, a timer may be utilized and the shield 306 may be moved from its block position to its unblock position after a predetermined period of time has lapsed. Specifically, in certain embodiments, the electric isolator 202 and/or the explosive isolator 206 may be controlled by one or more timers. For instance, in certain embodiments, the perforating gun 116 may include a programmable timer. The timer may then be set for a predetermined threshold time period corresponding to the time it takes for the perforating gun 116 to reach the safe depth for the particular wellbore. The threshold time period may also depend upon the speed at which the perforating gun 116 is lowered downhole. Once the timer is set, the electric isolator 202 and/or the explosive isolator 206 may be oriented to block the detonation pathway 210 and the perforating gun 116 may be directed downhole. The detonation pathway 210 will remain blocked until the threshold time is passed. Once the threshold time is passed, the timer will deactivate the electric isolator 202 and/or the explosive isolator 206 and unblock the detonation pathway 210. The perforating gun 116 may then operate in its normal operating mode.

Moreover, in certain embodiments, the shield 306 may move from one position to another in response to commands received from a control module (not shown). In certain embodiments, the control module may be an information handling system. The control module may be communicatively coupled to the shield 306 and may be integrated within the housing 308 of the ballistic interrupt 300.

In certain embodiments, the electric isolator 202 and/or the explosive isolator 206 may comprise a eutectic metal alloy including, but not limited to, Wood's metal or Field's metal, or any other eutectic metal alloys which are responsive to changes in temperature. The operation of such eutectic metals is well known to those of ordinary skill in the art, having the benefit of the present disclosure and will therefore not be discussed in detail herein.

Figure 4A:
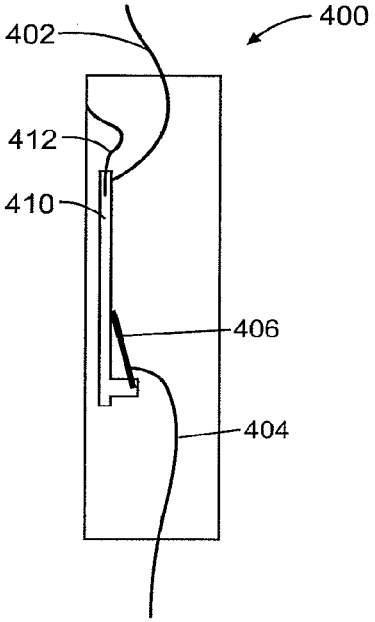
FIGS. 4A and 4B depicts a magnetically activated component for an electric isolator and/or an explosive isolator in accordance with an illustrative embodiment of the present disclosure.
Figure 4B:
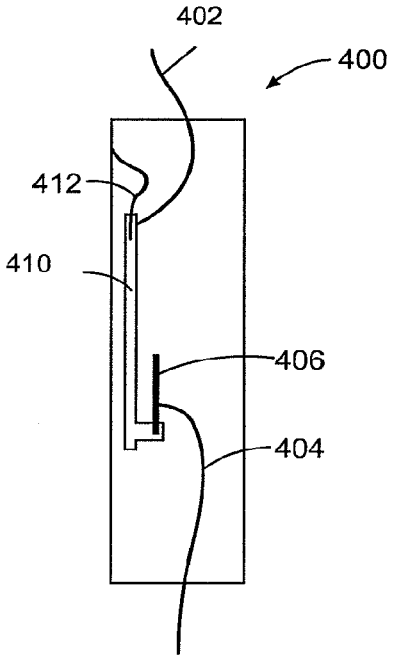

In certain embodiments, the electric isolator 202 and/or the explosive isolator 206 may be magnetically activated and deactivated. Specifically, the electric isolator 202 and/or the explosive isolator 206 may include a magnetically activated component denoted generally with reference numeral 400 in FIG. 4. FIGS. 4A and 4B show an illustrative embodiment where magnetic activation is used to selectively block (FIG. 4A) or un-block (FIG. 4B) the path for ballistic transfer to the perforating gun 116 components. The magnetically activated component 400 may include a "hot" wire 402. In certain embodiments, the hot wire 402 may be electrically coupled to a wireline used in performing subterranean operations as is known to those of ordinary skill in the art, having the benefit of the present disclosure. The magnetically activated component 400 may include a detonation wire 404 coupled to a switch 406 at an opposing end relative to the hot wire 402. A magnetic control PCB chassis ground wire 412 may be used to ground the magnetically activated component 400.

As shown in FIG. 4A, initially, the magnetically activated component 400 is in the block position. In this position, there is no magnetic field applied to the switch 406 and the switch 406 is in contact with the magnetic control PCB chassis 410 which is grounded by the ground wire 412. In certain embodiments, the switch 406 may be mechanically fixed to the magnetic control PCB chassis 410 to be "shorted" until the magnetic control PCB chassis 410 is powered. For instance, the switch 406 may be spring loaded to remain in the "shorted" position of FIG. 4A until a magnetic power is applied.

Once it is desired to change the magnetically activated component 400 to the unblock position of FIG. 4B, the magnetic control PCB chassis 410 may be activated/powered. Specifically power may be applied to the magnetic control PCB chassis 410. Moreover, in certain embodiments, the electric isolator 202 and/or the explosive isolator 206 may provide an electric line capability to selectively activate and deactivate the blocking feature. Specifically, a command may be sent from a control module located at the surface or elsewhere in the system to activate the magnetic control PCB chassis 410. In one embodiment, the control module may be an information handling system. Once the magnetic control PCB chassis 410 is activated, it applies a field which repels or otherwise pushes the conductive shorting medium provided by the switch 406 and creates a wire path through the circuit. As would be appreciated by those of ordinary skill in the art, with the benefit of this disclosure, the embodiment of FIG. 4 is depicted for illustrative purposes only and other methods may be used to magnetically activate/deactivate the electric isolator 202 and/or the explosive isolator 206. For instance, in certain embodiments, one or more micro-switches or other devices may be utilized.

Figure 5:
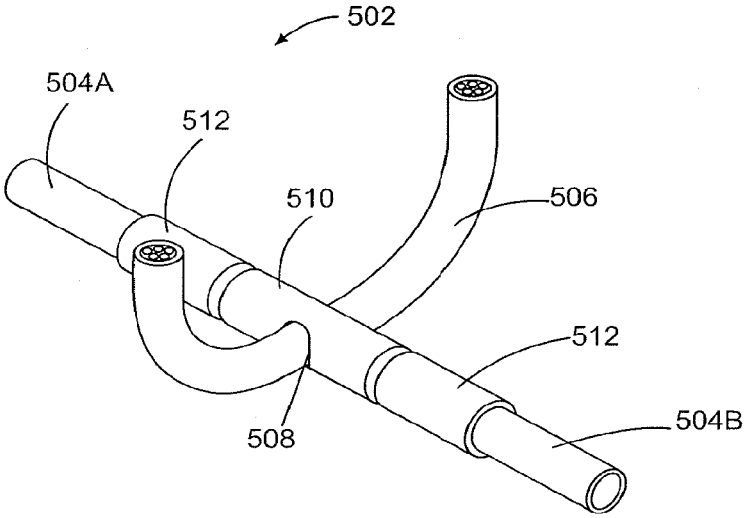
FIG. 5 depicts an illustrative embodiment of the present disclosure with a tool sub placed between electrical initiator and a detonation cord.

In certain embodiments, the electric isolator 202 and/or the explosive isolator 206 may include a mechanical blocking system which is installed at the surface and removed prior to deployment. Specifically, in certain embodiments, a tool sub (502) as shown in FIG. 5 may be placed between the electrical initiator 204 and a detonation cord. The tool sub 502 may isolate a first portion of the detonation cord 504A from a second portion 504B thereof using an interrupt material 506. The tool sub 502 may include a pressure sealable port 508 with the interrupt material 506 creating a mechanical block between the first portion of the detonation cord 504A and the second portion of the detonation cord 504B. The port 508 may be formed on an interrupt assembly body 510. The interrupt assembly body 510 may further improve the performance of the tool sub 502 by providing an air gap between the first portion of the detonation cord 504A and the second portion of the detonation cord 504B. Explosive boosters 512 may be provided in the tool sub 502 to improve a ballistic transfer between the first portion of the detonation cord 504A and the second portion of the detonation cord 504B when the interrupt material 506 is removed. In certain embodiments, the tool sub 502 may be a Detonator Interrupt Device such as, for example, Halliburton Part No. 101328346 available from Halliburton Energy Services of Duncan, Okla.

In certain embodiments, the electric isolator 202 and/or the explosive isolator 206 may be designed so that a minimum pressure is required to maintain the explosive train and detonate the perforating gun 116. For instance, the electric isolator 202 and/or the explosive isolator 206 may be a hydro-mechanical device. The minimum pressure to maintain the explosive train may depend on the properties of the particular well bore (e.g., surface pressure, fluid weight, depth to seabed, etc.). According, the operator in charge of performing the explosive operations at the wellsite must determine the correct setting or value of isolator to use for a particular application. If that minimum pressure is not available, the electric isolator 202 and/or the explosive isolator 206 may block the detonation pathway 210. Accordingly, a predetermined threshold pressure value corresponding to the safe depth for the wellbore may be used to program the electric isolator 202 and/or the explosive isolator 206 such that while the pressure is below the threshold pressure, they block the detonation pathway 210 and once the pressure exceeds the threshold pressure, they unblock the detonation pathway 210. The perforating gun 116 is then directed downhole through the pipe 104A and into the wellbore 105A. As the perforating gun 116 moves downhole, the pressure applied to the electric isolator 202 and/or the explosive isolator 206 increases with depth. Once the safe depth is reached and the pressure exceeds the threshold pressure, the electric isolator 202 and/or the explosive isolator 206 will unblock the detonation pathway 210, permitting normal operation of the perforating gun 116.

In certain embodiments, the perforating gun 116 may incorporate an accelerometer component. The accelerometer component measures tool movement. In order to meet the "Arm" function of the controlling electronics, the perforating gun 116 (and its corresponding accelerometer component) must remain stationary for a predetermined time period. The term "Arm function" as used herein refers to a process whereby the accelerometer and its control electronics meet certain predefined conditions and allow internal connection of electrical wire paths/control circuitry enabling application of power for the "fire gun" function. The "fire gun" functions refers to a process by which the perforating gun 116 detonates and fires to create perforations. The accelerometer component may prevent detonation of the explosives 208 if the perforating gun 116 has been moved within a given time period referred to as the "stationary time." In certain embodiments, the accelerometer may include a computer-readable medium where a value for the stationary time may be pre-set before the tool is directed downhole. Additionally, the accelerometer may be communicatively coupled to an information handling system permitting an operator to set a value for the stationary time in real-time.

Figure 6:
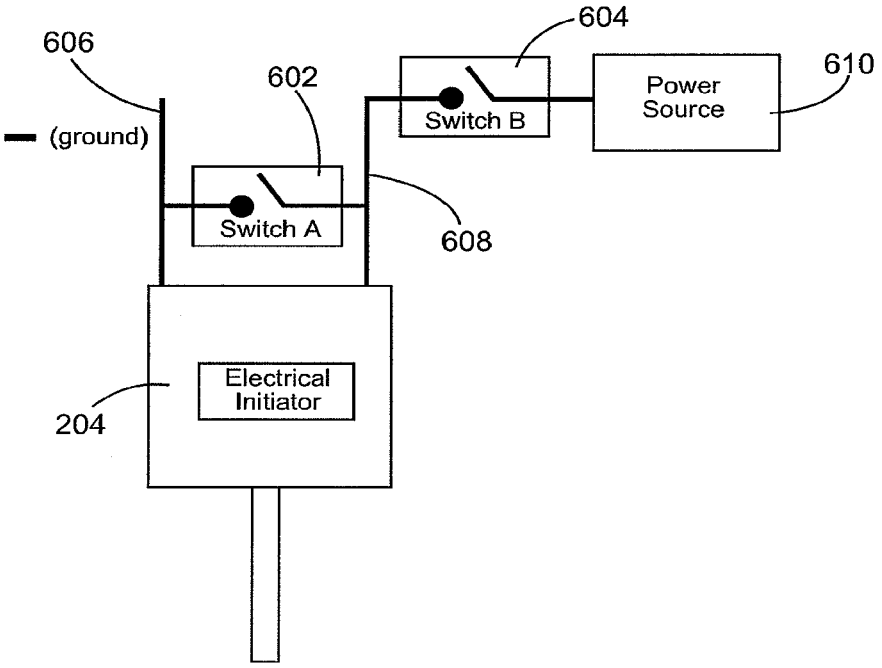
FIG. 6 depicts a perforating gun having a grounding feature in accordance with an illustrative embodiment of the present disclosure.

Turning now to FIG. 6, in certain embodiments, the perforating gun 116 may contain a grounding mechanism on the electrical initiator 204 which may prevent the electrical initiator 204 from firing and detonating the explosives 208. The grounding feature may be connected to a thermal switch that is closed (i.e., shorted to Ground) at surface temperatures and opens once the device reaches a location downhole having a pre-set temperature. In the illustrative embodiment of FIG. 6, two switches 602, 604 are utilized to control operation of the electrical initiator 204 by regulating the ground line 606 and the power line 608. A first switch 602 is placed between the ground line 606 and the power line 608 and a second switch 604 is operable to selectively connect the power line 608 to a power source 610.

Before the perforating gun 116 reaches the safe depth, the first switch 602 is closed and the second switch 604 is open. Therefore, the electrical initiator 204 is grounded and cannot initiate a detonation. Once the perforating gun 116 reaches the safe depth, the first switch 602 is opened and the second switch 604 is closed, electrically coupling the electrical initiator 204 to the power source 610. Accordingly, the electrical initiator 204 can facilitate detonation of the perforating gun 116 only after it reaches the safe depth. Although two switches 602, 604 are shown in the illustrative embodiment of FIG. 6, the present invention is not limited to any particular number or arrangement of switches and a different number and/or arrangement of switches may be used without departing from the scope of the present disclosure.

As would be appreciated by those of ordinary skill in the art, having the benefit of the present disclosure, the switches 602, 604 may be selectively opened and closed using a number of suitable mechanisms including, but not limited to, using a thermal switch, an accelerometer switch, a timer switch or a command from a control module. Specifically, a thermal switch may open/close the switches 602, 604 in response to changes in temperature. An accelerometer switch may open/close the switches 602, 604 in response to movement of the perforating gun 116 and a timer switch may open/close the switches 602, 604 after a pre-determined period of time has elapsed. The control module may be located at the surface or elsewhere in the system. In certain embodiments, the control module may be an information handling system.

Figure 7:
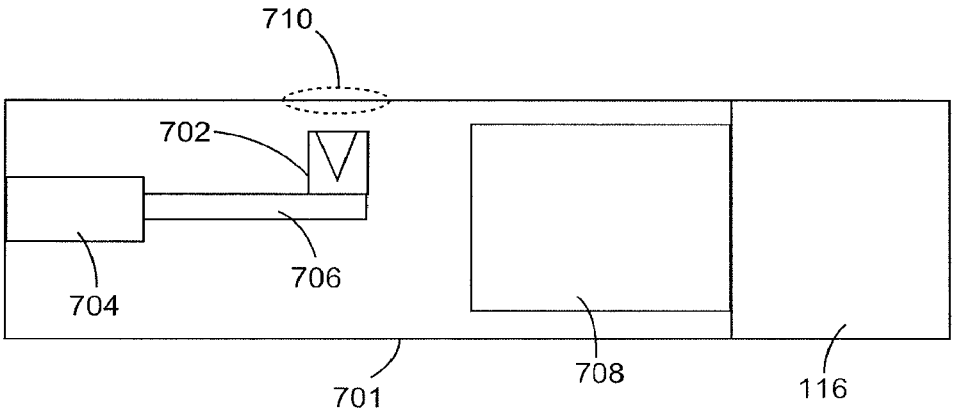
FIG. 7 depicts a perforating gun coupled to a housing having a peanut charge in accordance with an illustrative embodiment of the present disclosure.

In certain embodiments, the perforating gun 116 may be designed so that it includes a pre-detonation mechanism. Specifically, the perforating gun 116 may require a first necessary detonation or an "activating detonation" before the perforating gun 116 is activated and can perform subsequent detonations downhole. Specifically, as shown in FIG. 7, in certain embodiments, a housing 701 may be coupled to the perforating gun 116. Within the housing 701, a small shaped charge or a "peanut charge" 702 may be coupled to a detonator 704 by a detonating cord 706. The housing 701 may further include a pressure actuated detonator 708 that is ballistically coupled to the perforating gun 116. The term "ballistically coupled" as used herein refers to a direct or indirect connection between two components that permits ballistic transfer between the components. The detonator 704 may detonate the peanut charge 702 creating an activating detonation. The activating detonation may be small and contained within the housing 701. The activation detonation creates a hole 710 in the housing 701. Once the hole 710 is created in the housing 701, well bore pressure enters the housing 701 applying pressure to the pressure actuated detonator 708. This pressure activates the pressure actuated detonator 708 which will then activate the perforating gun.

Figure 8:
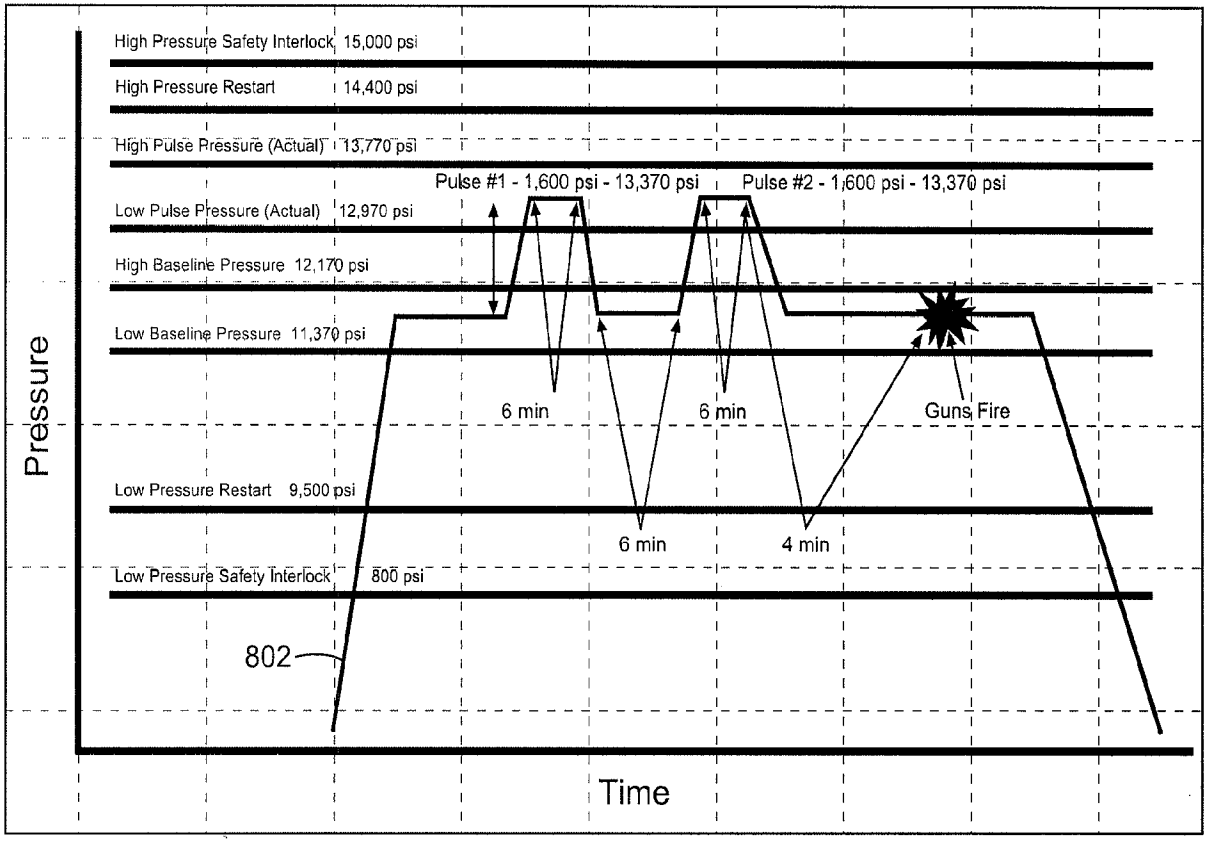
FIG. 8 depicts a chart representing utilization of an electrical signature to selectively activate/deactivate a perforating gun in accordance with an illustrative embodiment of the present disclosure.

As shown in FIG. 8, in certain embodiments, the perforating gun 116 may be designed so that an electrical signature or an electrical sequence may be utilized to selectively activate and/or deactivate the electric isolator 202 and/or the explosive isolator 206. Specifically, in the illustrative embodiment of FIG. 8, a pressure actuation sequence is used to selectively activate/deactivate the perforating gun 116. An information handling system (not shown) may be used to interpret the voltage sequence and manage the perforating gun 116 accordingly.

Specifically, the Y-axis of FIG. 8 reflects pressure with each horizontal line reflecting a particular pressure value. Each horizontal pressure line indicates a pre-programmed condition that must be met downhole before arming the gun. The term "arming the gun" as used herein refers to activating the perforating gun 116 by deactivating any electric isolators 202 and/or explosive isolators 206. In the illustrative embodiment of FIG. 8, a low pressure safety interlock and a high pressure safety interlock are set at 800 psi and 15,000 psi, respectively. The low pressure safety interlock value indicates the low pressure limit that must be exceeded to allow the on-board logic in the downhole controller to be enabled. Stated otherwise, for pressures below this minimum value the controller is inactive. Once this minimum pressure value is attained, the tool turns on and controls the arming and firing of the guns, once the pre-programmed inputs are met. In contrast, the high pressure safety interlock indicates the high pressure that if exceeded, will cause the downhole tool to "lock," disarm the gun, and no longer accept pressure commands. Accordingly, the tool must then be recovered to the surface for reprogramming.

If the expected downhole pressures are not met or the sequence of events required for arming do not occur, a low pressure restart is designated that allows the downhole tool including the perforating guns to be exposed to a low pressure value that may cause the tool to restart the command acceptance sequence. Similarly, the high pressure restart value is designated to allow a system restart using a designated high pressure instead of the designated low pressure. In the illustrative embodiment of FIG. 8, a low pressure restart and a high pressure restart are set at 9,500 psi and 14,400 psi, respectively.

A low baseline pressure and a high baseline pressure are set at 11,370 psi and 12,170 psi, respectively. The low baseline pressure and the high baseline pressure define a pre-programmed pressure range that a sensing device must measure, agree that the perforating gun 116 is within that range and then allow the next sequence to start. The sensing device is any suitable device that may be used to determine pressure at the location where the perforating gun 116 is disposed. Accordingly, the sensing device may be any sensor with the accuracy to measure the pressure ranges experienced downhole. For instance, in certain embodiments, the sensing device may be a quartz pressure gauge or a strain pressure gauge. The next sequence may be the low pulse and high pulse pressure range indicated in FIG. 8.

A series of commands or measurements must be met once the tool including the perforating gun reaches a desired depth where it is to be armed. For instance, as discussed above, the tool must have satisfied the low pressure safety interlock, the low pressure baseline, etc. In order to arm the perforating gun, a sequence of commands may be sent using applied surface pressure as the medium. The tool should be in the wellbore at a pressure range between the low pressure baseline and the high pressure baseline. To arm the perforating gun, pressure may be applied at the surface to be in the range shown as the Low Pulse Pressure and the High Pulse Pressure. The applied pressure must then be held for a predefined time. Once the command sequence has been met and accepted as valid, the tool will arm the gun and prepare to fire. In the illustrative embodiment of FIG. 8, a low pulse pressure and a high pulse pressure are set at 12,970 psi and 13,770 psi, respectively, to define the low pulse and high pulse pressure range.

Accordingly, once the tool that contains the perforating gun 116 determines that the external wellbore pressure measured by its sensing device falls within the base line range (define by the low baseline pressure and the high baseline pressure), pressure may be applied at the surface. The pressure applied at the surface may be calculated to fall between the low/high pulse pressure thresholds. As a result, as indicated along the time axis (x-axis in FIG. 8), a series of measurements must occur within a certain pre-programmed time or the perforating gun will not be permitted to be Armed and Fire.

The line 802 depicts an illustrative implementation showing the pressure values measured by the sensing device coupled to the perforating gun 116 in order to Arm and fire the perforating gun 116. Specifically, the line 802 is an indication of what pressures the downhole tool may measure over time to allow an arming sequence and a fire command. The pulses (1 and 2) are representations of the expected measurements the perforating gun should see while downhole. These pulses are based on pressure and time.

Although certain pressure values are reflected in FIG. 8, as would be appreciated by those of ordinary skill in the art, having the benefit of the present disclosure, the present invention is not limited to any particular pressure values and the values may be changed without departing from the scope of the present disclosure.

Although FIG. 8 is discussed in conjunction with variations in pressure, it would be appreciated by those of ordinary skill in the art, having the benefit of this disclosure, that changes in voltage may be used in a manner similar to that discussed above with respect to changes in pressure. Specifically, the control module or an information handling system may interpret pressure or line voltage, one or both of which may be capable of arming the perforating gun 116 if cycled through the properly designated sequence.

During operation, the perforating gun 116 may be communicatively coupled to a receiver (not shown) on the platform 102 or located remotely from the platform 102. In one embodiment, the receiver may be part of an information handling system (now shown), which also provides a graphical user interface to facilitate monitoring and manipulation of the perforating gun 116 by an operator. The perforating gun 116 may then notify the receiver whether the electric isolator 202 and/or the explosive isolator 206 is blocking the detonation pathway 210 or if the detonation pathway 210 has remained open.

Therefore, the present disclosure is well adapted to carry out the objects and attain the ends and advantages mentioned as well as those that are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method for concurrent performance of a drilling operation and a perforating operation comprising:

placing a platform at a location where subterranean operations are to be performed;

drilling a first well bore in a formation using drilling equipment on the platform, wherein drilling the first well bore comprises activating a top drive;

performing a perforating operation in a second well bore extending from the platform, wherein the perforating operation in the second well bore is performed concurrently with drilling the first well bore, wherein the perforating operation is performed using a perforating gun, wherein the perforating gun comprises at least one of an electric isolator and an explosive isolator, and wherein the explosive isolator is operable to substantially isolate the electrical initiator from the explosive, wherein the electric isolator is operable to substantially isolate the electrical initiator from the platform, and wherein the perforating gun is activated when the perforating gun reaches a safe depth, wherein activating the perforating gun comprises receiving one or more measurements within a predetermined time when the perforating gun reaches the safe depth, determining if one or more predetermined criteria have been met based, at least in part, on the one or more measurements, sending a sequence of commands to the perforating gun, receiving a validation of the sequence of commands and arming the perforating gun based at least in part on at least one of the validation and the determination.

2. The method of claim 1, wherein the platform is selected from a group consisting of a floating rig, a permanent platform, and a land rig.

3. The method of claim 1, wherein at least one of the electric isolator and the explosive isolator is regulated using a mechanism selected from a group consisting of a thermal switch, a eutectic metal alloy, a ballistic interrupt, a timer switch, a control module, a magnetically activated component, a mechanical blocking system, a hydro-mechanical device, an accelerometer component, a grounding mechanism, a pre-detonation mechanism, and an electrical sequence.

4. The method of claim 3, wherein the ballistic interrupt is operable to selectively ballistically couple a first ballistic terminal and a second ballistic terminal.

5. The method of claim 4, wherein movement of a shield between a first position and a second position selectively ballistically couples a first ballistic terminal and a second ballistic terminal.

6. The method of claim 5, wherein gravitational force moves the shield between the first position and the second position.

7. The method of claim 3, wherein the control module is an information handling system.

8. The method of claim 3, wherein the grounding mechanism comprises a first switch and a second switch and wherein the first switch and the second switch are operable to selectively supply power to the perforating gun.

9. The method of claim 1, wherein activating the perforating gun comprises at least one of deactivating the electric isolator and deactivating the explosive isolator.

10. The method of claim 1, wherein at least one of the electric isolator and the explosive isolator is regulated using a pressure actuation sequence.

11. The system of claim 10, wherein activating the perforating gun comprises at least one deactivating the electric isolator and deactivating the explosive isolator.

12. The system of claim 10, wherein at least one of the electric isolator and the explosive isolator is regulated using a pressure actuation sequence.

13. A system for selective electrical isolation of a perforating operation in a first wellbore extending from a platform comprising:

a perforating gun comprising an electrical initiator and an explosive;

an electric isolator, wherein the electric isolator is operable to substantially isolate the electrical initiator from the platform;

an explosive isolator, wherein the explosive isolator is operable to substantially isolate the electrical initiator from the explosive, and wherein the electric isolator and the explosive isolator are operable to regulate operation of a detonation pathway;

an information handling system comprising a receiver coupled to the perforating gun, wherein the receiver is configured to receive one or more measurements within a predetermined time when the perforating gun reaches a safe depth, wherein the information handling system is configured to determine if one or more predetermined criteria have been met based, at least in part, on the one or more measurements, wherein the information handling system is configured to transmit sequence of commands to the perforating gun, wherein the information handling system is configured to receive a validation of the sequence of commands, and wherein the information handling system is configured to arm the perforating gun based, at least in part, on at least one of the validation and the determination.

14. The system of claim 13, wherein the platform is selected from a group consisting of a floating rig, a permanent platform, and a land rig.

15. The system of claim 13, wherein at least one of the electric isolator and the explosive isolator is regulated using a mechanism selected from a group consisting of a thermal switch, a eutectic metal alloy, a ballistic interrupt, a timer switch, a control module, a magnetically activated component, a mechanical blocking system, a hydro-mechanical device, an accelerometer component, a grounding mechanism, a pre-detonation mechanism, and an electrical sequence.

16. The system of claim 15, wherein the ballistic interrupt is operable to selectively ballistically couple a first ballistic terminal and a second ballistic terminal.

17. The system of claim 16, wherein movement of a shield between a first position and a second position selectively ballistically couples a first ballistic terminal and a second ballistic terminal.

18. The system of claim 17, wherein gravitational force moves the shield between the first position and the second position.

19. The system of claim 15, wherein the control module is an information handling system.

20. The system of claim 15, wherein the grounding mechanism comprises a first switch and a second switch and wherein the first switch and the second switch are operable to selectively supply power to the perforating gun.

* * * * *